US007311210B2

(12) United States Patent
Jones

(10) Patent No.: US 7,311,210 B2
(45) Date of Patent: Dec. 25, 2007

(54) HIGH HEEL SHOE ENVELOPE HOLDER

(75) Inventor: Brenda S. Jones, Raleigh, NC (US)

(73) Assignee: Adstracts, Inc., Raleigh, NC (US)

( * ) Notice: Subject to any disclaimer, the term of this patent is extended or adjusted under 35 U.S.C. 154(b) by 0 days.

(21) Appl. No.: 11/167,415

(22) Filed: Jun. 27, 2005

(65) Prior Publication Data

US 2006/0289365 A1 Dec. 28, 2006

(51) Int. Cl.
*A47F 7/14* (2006.01)

(52) U.S. Cl. ..... 211/50; 211/13.1; 211/10

(58) Field of Classification Search ..... 211/50; D02/896, 897, 916, 936; 36/86
See application file for complete search history.

(56) References Cited

U.S. PATENT DOCUMENTS

D110,448 S * 7/1938 Sholtz ..... D2/930
3,070,908 A * 1/1963 Lipare ..... 36/11.5
D259,822 S * 7/1981 Melzi et al. ..... D2/926
D293,967 S * 2/1988 Maciel ..... D2/916
D332,518 S * 1/1993 Middleton ..... D2/916
6,268,573 B1 * 7/2001 Hartselle, III ..... 177/148
D448,145 S * 9/2001 Jacobs ..... D2/916
D461,626 S * 8/2002 Hisamatsu ..... D2/926
D481,861 S * 11/2003 Robbins ..... D2/969
D500,399 S * 1/2005 Fuerst ..... D2/926
7,047,669 B2 * 5/2006 Polcek ..... 36/25 R

* cited by examiner

*Primary Examiner*—Kambiz Abdi
*Assistant Examiner*—Lindsay M. Maguire
(74) *Attorney, Agent, or Firm*—Myers Bigel Sibley & Sajovec, P.A.

(57) ABSTRACT

An envelope holder having the shape of a lady's high heel shoe includes an elongated sole having a forward toe portion and a raised heel portion. A heel extends downwardly from the heel portion and supports the heel portion when the envelope holder is in an operative position. A plurality of spaced apart rigid retaining members extend upwardly from the toe portion and are configured to retain envelopes placed therebetween. When the envelope holder is in an operative position, the toe portion is configured to lie substantially flat on a surface.

13 Claims, 2 Drawing Sheets

HIGH HEEL SHOE ENVELOPE HOLDER

FIELD OF THE INVENTION

The present invention relates generally to article holders and, more particularly, to holders for office supplies and the like.

BACKGROUND OF THE INVENTION

Desk organizers for holding various office accessories, such as pens, pencils, memo pads, papers, documents and envelopes, clips, scissors, business cards, and the like, are known. These organizers are advantageous in that the can help eliminate desk clutter. Unfortunately, many such organizers lack distinctiveness and are not aesthetically pleasing. Thus, there is a need for desk organizers that are distinctive and more aesthetically pleasing from a visual point of view.

SUMMARY OF THE INVENTION

In view of the above discussion, an envelope holder having the shape of a lady's high heel shoe is provided and includes an elongated sole having a forward toe portion and a raised heel portion. A heel (e.g., a spike or stiletto heel) extends downwardly from the heel portion and supports the heel portion when the envelope holder is in an operative position. A plurality of spaced apart rigid retaining members extend upwardly from the toe portion and are configured to retain envelopes placed therebetween. When the envelope holder is in an operative position, the toe portion is configured to lie substantially flat on a surface.

According to embodiments of the present invention retaining members have an arcuate configuration and are oriented substantially transverse to a longitudinal direction defined by the elongated sole. According to embodiments of the present invention, the retaining members extend to respective different elevations above the toe portion. The retaining members are designed to hold envelopes placed therebetween.

The envelope holder is unsuitable for wear as a shoe by a person. Unlike an actual shoe that can be worn, the envelope holder is substantially rigid, is too small for a person's foot, and is not capable of supporting the weight of a person.

DETAILED DESCRIPTION OF THE INVENTION

Figure 1:
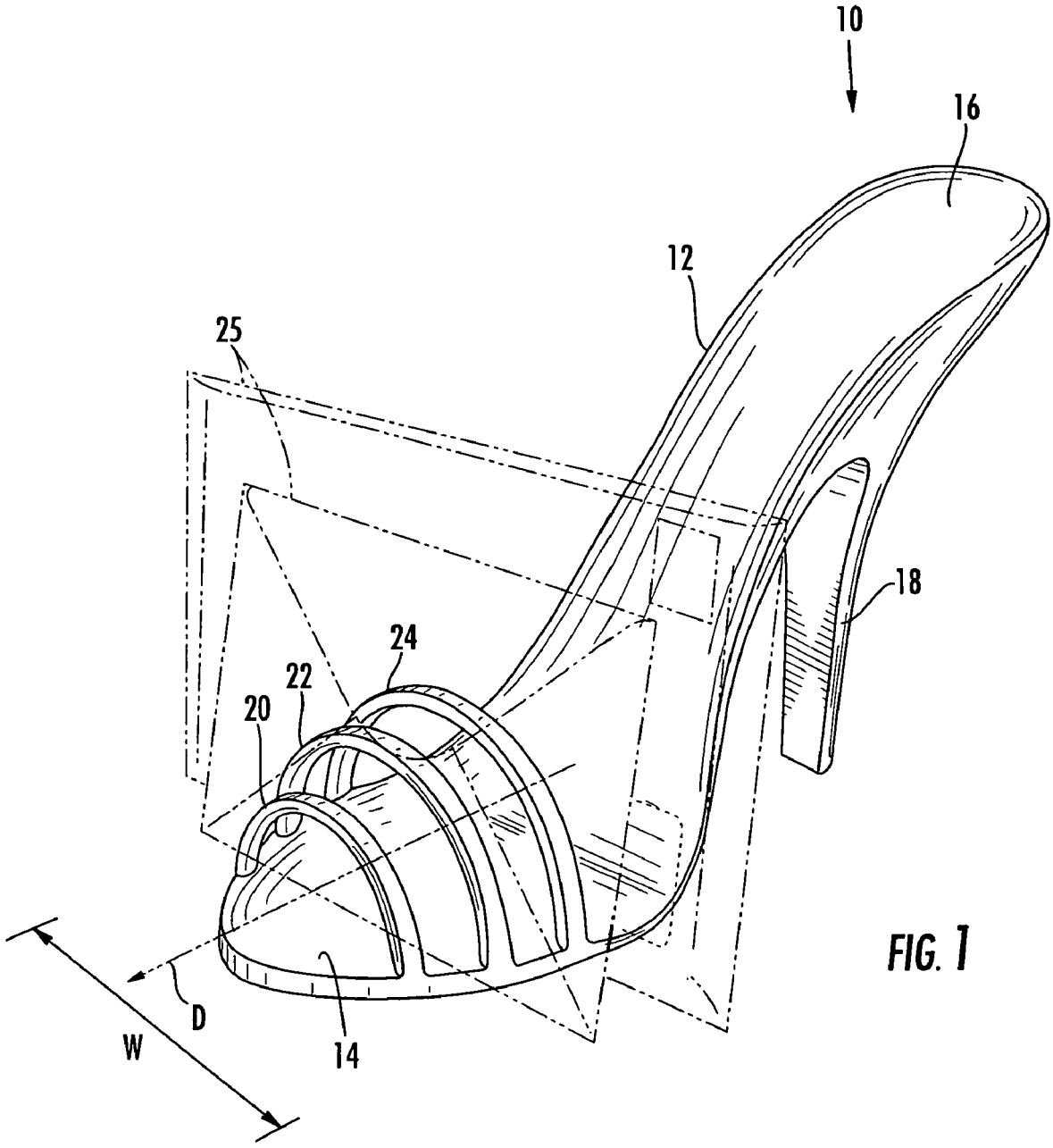
FIG. 1 is a perspective view of an envelope holder, according to embodiments of the present invention.

The present invention now is described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity. Broken lines illustrate optional features or operations unless specified otherwise. All publications, patent applications, patents, and other references mentioned herein are incorporated herein by reference in their entireties.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. Thus, the exemplary term "under" can encompass both an orientation of "over" and "under". The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

It will be understood that, although the terms "first", "second", etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a "first" element, component, region, layer or section discussed below could also be termed a "second" element, component, region, layer or section without departing from the teachings of the present invention. The sequence of operations (or steps) is not limited to the order presented in the claims or figures unless specifically indicated otherwise.

Figure 2:
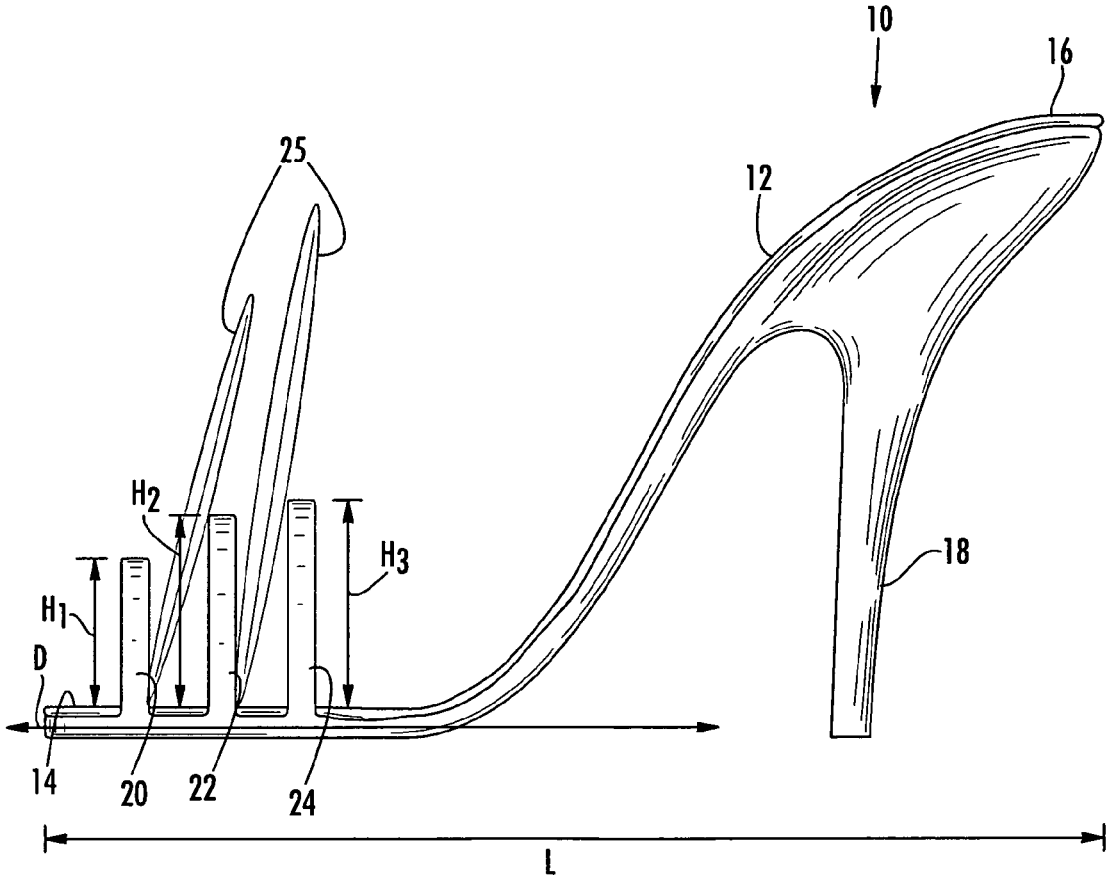
FIG. 2 is a side elevation view of the holder of FIG. 1.

Referring now to FIGS. 1-2, an envelope holder 10 according to an embodiment of the present invention is illustrated. The illustrated envelope holder 10 has the shape of a high heel shoe; however, the envelope holder 10 is unsuitable for wear as a shoe by a person. The envelope holder 10 is too small for a person's foot and is not capable of supporting the weight of a person. For example, the envelope holder has a length L of less than or equal to about 6 inches, and a width W of less than or equal to about 3.4 inches, and preferably a length L of less than or equal to about 5 inches, and a width W of less than or equal to about 2.4 inches. The envelope holder 10 includes an elongated sole 12 having a forward toe portion 14 and a raised heel portion 16. A heel 18 extends downwardly from the heel portion 16 and supports the heel portion 16 when the envelope holder 10 is in an operative position (i.e., when the envelope holder 10 is on a generally horizontal surface).

The illustrated heel 18 is a spike heel (also referred to as a stiletto heel). However, other styles of high heels may be utilized, without limitation.

The illustrated envelope holder 10 also includes first, second and third spaced apart rigid retaining members 20, 22, 24 extending upwardly from the toe portion 14. The illustrated retaining members 20, 22, 24 have an arcuate configuration and are oriented substantially transverse to a longitudinal direction D defined by the elongated sole 12. However, it is understood that the retaining members 20, 22, 24 may have virtually any shape and configuration and are not limited to an arcuate configuration and/or to the illustrated orientation. More than three retaining members may be utilized according to other embodiments of the present invention. In addition, only two retaining members are necessary.

The first and second retaining members 20, 22 are configured to retain envelopes 25 placed therebetween, and the second and third retaining members 22, 24 are configured to retain envelopes placed therebetween, as illustrated. In the illustrated embodiment, the second retaining member 22 extends to an elevation $H_2$ above the toe portion 14 that is higher than an elevation $H_1$ of the first retaining member 20, and the third retaining member 24 extends to an elevation $H_3$ above the toe portion 14 that is higher than an elevation $H_2$ of the second retaining member 22.

However, according to other embodiments of the present invention, the retaining members 20, 22, 24 may have other configurations and may extend to different respective elevations (including the same elevation) above the toe portion 14. In addition, according to other embodiments of the present invention, there may be different numbers of rigid retaining members.

According to other embodiments of the present invention, biasing members (e.g., spring members, etc.) may be utilized with the retaining members 20, 22, 24 so as to grip envelopes placed between the retaining members. Alternatively, the retaining members 20, 22, 24 may themselves be capable of biasing toward each other so as to grip envelopes placed therebetween.

Unlike an actual shoe that can be worn, the envelope holder 10 is substantially rigid. For example, the elongated sole 12, heel 18, and retaining members 20, 22, 24 are formed from substantially rigid material including, but not limited to, rigid polymeric material, wood, metal, glass, etc. The envelope holder 10 may be formed from a single piece of rigid material, or may be the combination of various rigid pieces of material. For example, the sole 12, heel 18, and retaining members 20, 22, 24 may be separate rigid pieces joined together. Alternatively, the envelope holder 10 may be formed as a unitary article.

When the envelope holder 10 is in an operative position, as illustrated in FIG. 1, the toe portion 14 is configured to lie substantially flat on a generally horizontal surface. According to embodiments of the present invention, the toe portion 14 and/or the heel 18 of the envelope holder 10 may include additional weight to help maintain the envelope holder 10 in the operative position. For example, the toe portion 14 and/or heel 18 may include weights and/or may include heavier/denser material. Moreover, the toe portion 14 and/or heel 18 may be configured to be removably secured to a surface, such as via adhesive, hook and loop fasteners, and the like. The envelope holder 10 may also be mounted to a platform or other supporting structure.

According to embodiments of the present invention, the envelope holder 10 may include promotional indicia. If the envelope holder 10 is mounted to a supporting platform, the platform may also include promotional indicia.

According to embodiments of the present invention, the elongated sole upper surface 12*a* may have a decorative appearance. For example, the elongated sole upper surface 12*a* may have decorative material and/or designs thereon. Moreover, the material of the envelope holder 10 may have one or more colors and/or one or more designs.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. The invention is defined by the following claims, with equivalents of the claims to be included therein.

That which is claimed is:

1. A combination envelope and envelope holder in the shape of a shoe having a heel, comprising:

an elongated sole having a forward toe portion and a raised heel portion;

a heel extending downwardly from the heel portion that supports the heel portion;

first, second, and third spaced apart retaining members extending upwardly from the toe portion that are configured to retain envelopes placed therebetween; and at least one envelope disposed between the first and second retaining members.

2. The envelope holder of claim 1, wherein the toe portion is configured to lie substantially flat on a surface when the envelope holder is in an operative position.

3. The envelope holder of claim 1, wherein the first, second, and third retaining members have an arcuate configuration.

4. The envelope holder of claim 1, wherein the first, second, and third retaining members are substantially transverse to the longitudinal direction defined by the elongated sole.

5. The envelope holder of claim 1, wherein the second retaining member extends to an elevation that is higher than an elevation of the first retaining member.

6. The envelope holder of claim 1, wherein the heel is a spike heel.

7. The envelope holder of claim 1, wherein each retaining member is orthogonal to the toe portion.

8. The envelope holder of claim 1, wherein the elongated sole, heel and retaining members are formed as a unitary article from rigid material selected from the group consisting of rigid polymeric material, wood, metal, and glass.

9. A combination envelope and envelope holder in the shape of a shoe having a heel, comprising:

an elongated rigid sole having a forward toe portion and a raised heel portion;

a rigid heel extending downwardly from the heel portion that supports the heel portion;

first, second and third spaced apart rigid retaining members extending upwardly from and orthogonal to the toe portion, wherein the first and second retaining members are configured to retain envelopes placed therebetween, wherein the second and third retaining members are configured to retain envelopes placed therebetween, and wherein the elongated sole, heel and retaining members are formed as a unitary article from rigid material selected from the group consisting of rigid polymeric material, wood, metal, and glass; and at least one envelope disposed between the first and second and/or second and third retaining members.

10. The envelope holder of claim 9, wherein the toe portion is configured to lie substantially flat on a surface when the envelope holder is in an operative position.

11. The envelope holder of claim 9, wherein the first, second and third retaining members have an arcuate configuration.

12. The envelope holder of claim 9, wherein the second retaining member extends to an elevation that is higher than an elevation of the first retaining member, and wherein the third retaining member extends to an elevation that is higher than an elevation of the second retaining member.

13. The envelope holder of claim 9, wherein the heel is a spike heel.

* * * * *